US007086371B2

(12) United States Patent
Sanada et al.

(10) Patent No.: US 7,086,371 B2
(45) Date of Patent: Aug. 8, 2006

(54) ENGINE

(75) Inventors: Makoto Sanada, Saitama (JP); Shumpei Hasegawa, Saitama (JP); Minoru Matsuda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 52 days.

(21) Appl. No.: 10/898,263

(22) Filed: Jul. 26, 2004

(65) Prior Publication Data

US 2005/0115524 A1 Jun. 2, 2005

(30) Foreign Application Priority Data

Jul. 30, 2003 (JP) ..... 2003-283027

(51) Int. Cl.
*F02B 75/22* (2006.01)

(52) U.S. Cl. ..... 123/195 R; 123/54.1

(58) Field of Classification Search ..... 123/195 R, 123/54.1, 55.2, 55.4–55.7
See application file for complete search history.

(56) References Cited

U.S. PATENT DOCUMENTS 2,154,402 A * 4/1939 Kahn ..... 123/54.2
6,073,595 A * 6/2000 Brogdon ..... 123/55.5
2002/0056430 A1* 5/2002 Matsuda et al. ..... 123/90.64

FOREIGN PATENT DOCUMENTS

| | | |
|---|---|---|
| DE | 10 2004 035 025 A1 | 2/2005 |
| FR | 1.038.779 | 10/1953 |
| FR | 2 813 640 | 9/2000 |
| GB | 768684 | 2/1957 |
| JP | 2002-213302 A | 7/2002 |

* cited by examiner

*Primary Examiner*—Noah P. Kamen
(74) *Attorney, Agent, or Firm*—Birch, Stewart, Kolasch & Birch, LLP

(57) ABSTRACT

To reduce the number of parts, improve the mountability and maintainability, and allow for a reduction in the size and weight an engine is provided having a crankshaft, a crankcase having a plurality of bearing portions for rotatably supporting the crankshaft with each of the bearing portions being dividable along a divisional plane arranged on the axis of the crankshaft. Cylinder barrels are connected to the crankcase and include cylinder bores with cylinder heads connected to the cylinder barrels. The cylinder heads are integrated with portions of the cylinder barrels forming at least the cylinder bores to form cylinder blocks. The cylinder blocks and the crankcase are fastened together by a plurality of fastening bolts having axes parallel to the axes of the cylinder bores and extending through at least the cylinder blocks, with a compressive structure in the axial direction of the fastening bolts.

18 Claims, 10 Drawing Sheets

ENGINE

CROSS-REFERENCE TO RELATED APPLICATIONS

The present application claims priority under 35 USC 119 to Japanese Patent Application No. 2003-283027 filed on Jul. 30, 2003 the entire contents thereof is hereby incorporated by reference.

BACKGROUND OF THE INVENTION

1. Field of the Invention Field

The present invention relates to an engine, and more particularly to an engine having a crankshaft with a crankcase having a plurality of bearing portions for rotatably supporting the crankshaft, each of the bearing portions being dividable along a divisional plane arranged on the axis of the crankshaft. Cylinder barrels are connected to the crankcase with the cylinder barrels having cylinder bores with axes that are perpendicular to the divisional plane. The cylinder heads are connected to the cylinder barrels.

2. Description of Background Art

In a conventional engine disclosed in Japanese Patent Laid-Open No. 2002-213302, for example, a crankcase, cylinder barrels, and cylinder heads are formed as separate members. The cylinder barrels are fastened to the crankcase, and the cylinder heads are fastened to the cylinder barrels with gaskets interposed therebetween.

In the above conventional structure, the number of bolts for fastening the crankcase, the cylinder barrels, and the cylinder heads is large, and it is hard to say that the mountability and maintainability are excellent. Further, since the gaskets for high temperature and high pressure are interposed between the cylinder barrels and the cylinder heads, the fastening loads on the cylinder barrels and the cylinder heads must be set to a large value, so that the space and weight occupied by such fastening portions of the cylinder barrels and the cylinder heads become relatively large.

SUMMARY AND OBJECTS OF THE INVENTION

It is accordingly an object of the present invention to provide an engine which can reduce the number of parts, improve the mountability and maintainability, and further reduce the size and weight.

In accordance with the present invention, there is provided an engine having a crankshaft with a crankcase having a plurality of bearing portions for rotatably supporting said crankshaft. Each of the bearing portions is dividable along a divisional plane arranged on the axis of said crankshaft. Cylinder barrels are connected to said crankcase with the cylinder barrels having cylinder bores with axes that are perpendicular to the divisional plane.

The cylinder heads are connected to the cylinder barrels with the cylinder beads being integrated with portions of said cylinder barrels forming at least said cylinder bores to form cylinder blocks. The cylinder blocks and said crankcase are fastened together by a plurality of fastening bolts having axes parallel to the axes of said cylinder bores and extending through at least the cylinder blocks, with a compressive structure in the axial direction of said fastening bolts.

In accordance with the present invention, the engine is of a horizontally opposed type including a pair of left and right cylinder blocks and a pair of left and right case halves connected together to constitute the crankcase located between said left and right cylinder blocks. The left and right cylinder blocks have a plurality of left and right cylinder bores offset from each other in the axial direction of said crankshaft. The left and right case halves have a plurality of journal support walls cooperating with each other to form said bearing portions. Fastening bolts are located at positions corresponding to said journal support walls.

In accordance with the present invention, the plurality of left cylinder bores formed in said left cylinder block are offset from said plurality of right cylinder bores formed in said right cylinder block in the axial direction of said crankshaft by a given amount equal to ½ of the pitch of said left cylinder bores or said right cylinder bores.

According to the present invention, the cylinder heads are integrated with portions of the cylinder barrels forming at least the cylinder bores to form the cylinder blocks. The cylinder blocks and the crankcase are fastened together under compression by the plurality of fastening bolts extending through at least the cylinder blocks. Accordingly, the machinability of the cylinder bores can be improved by forming the cylinder barrels and the crankcase as separate members. Further, any gasket for high temperature and high pressure that are conventionally required between each cylinder barrel and the corresponding cylinder head for the purpose of sealing between each combustion chamber and the outside can be eliminated. Accordingly, the number of bolts for fastening the crankcase, the cylinder barrels, and the cylinder heads can be reduced to thereby improve the mountability and maintainability.

Further, since the above-mentioned gasket is not provided, axial tensions of the fastening bolts can be controlled stably. In addition, it is sufficient for the fastening bolts to have a strength withstanding a tensile stress due to the combustion in the combustion chambers. Accordingly, the fastening bolts can be relatively reduced in number, and the diameter of each fastening bolt can be set to a relatively small value. Further, any fastening portion conventionally required between each cylinder barrel and the corresponding cylinder head can be eliminated, thereby obtaining an advantage in size and a reduction in the weight of the engine.

According to the present invention, size enlargement of the engine due to the location of the fastening bolts can be avoided, and the journal support walls of the left and right case halves can be firmly coupled together to support the crankshaft.

According to the present invention, the coordinates of the fastening bolts in the left cylinder block can be set equal to those of the fastening bolts in the right cylinder block, and cylinder blocks having the same shape can be located on the left and right sides of the crankcase.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A preferred embodiment of the present invention will now be described with reference to the attached drawings.

FIGS. 1 to 9 show a first preferred embodiment of the present invention wherein it is applied to a four-cycle, horizontally opposed, four-cylinder engine.

Figure 1:
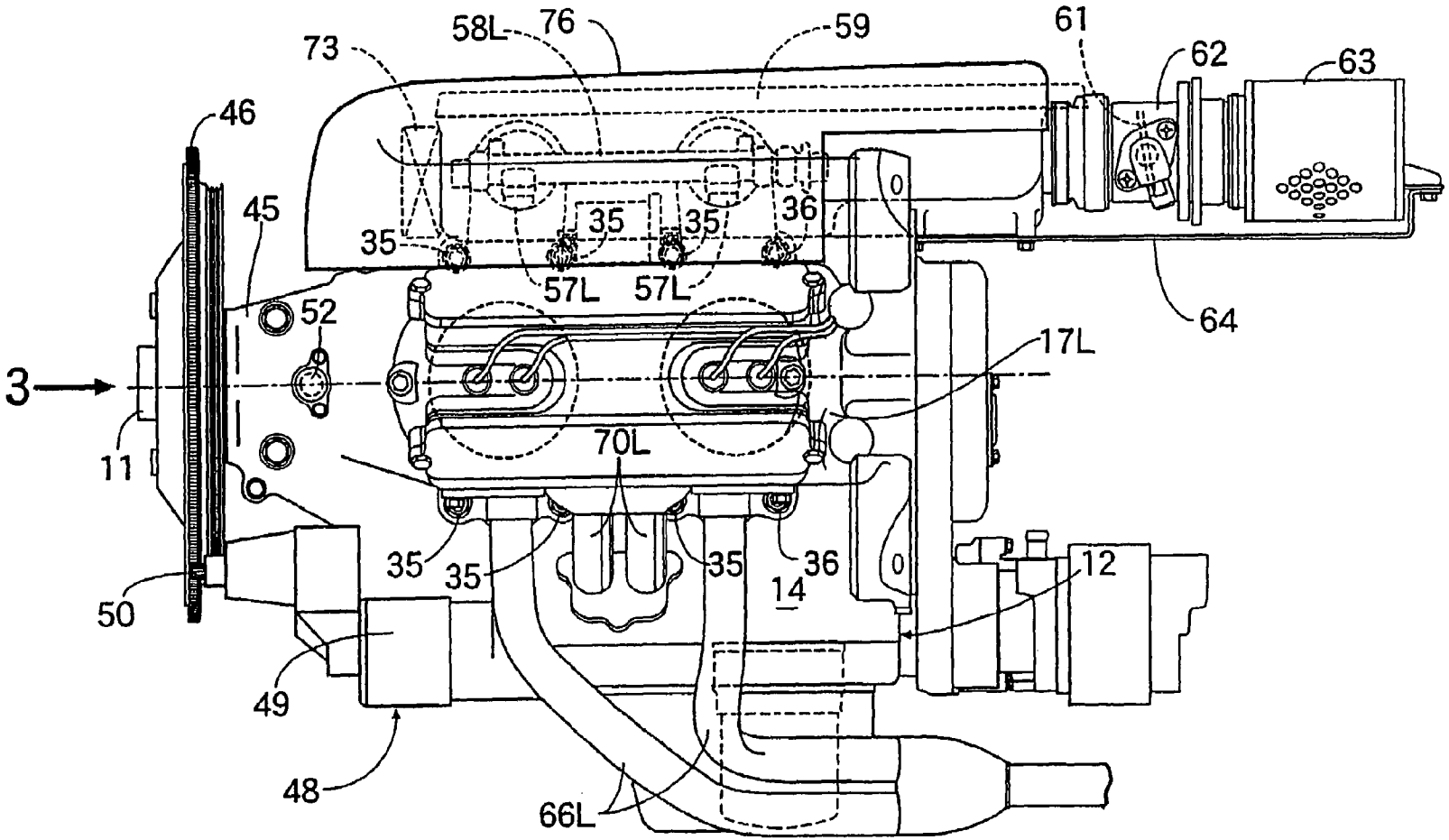
FIG. 1 is a side view of an engine according to a first preferred embodiment of the present invention.
Figure 2:
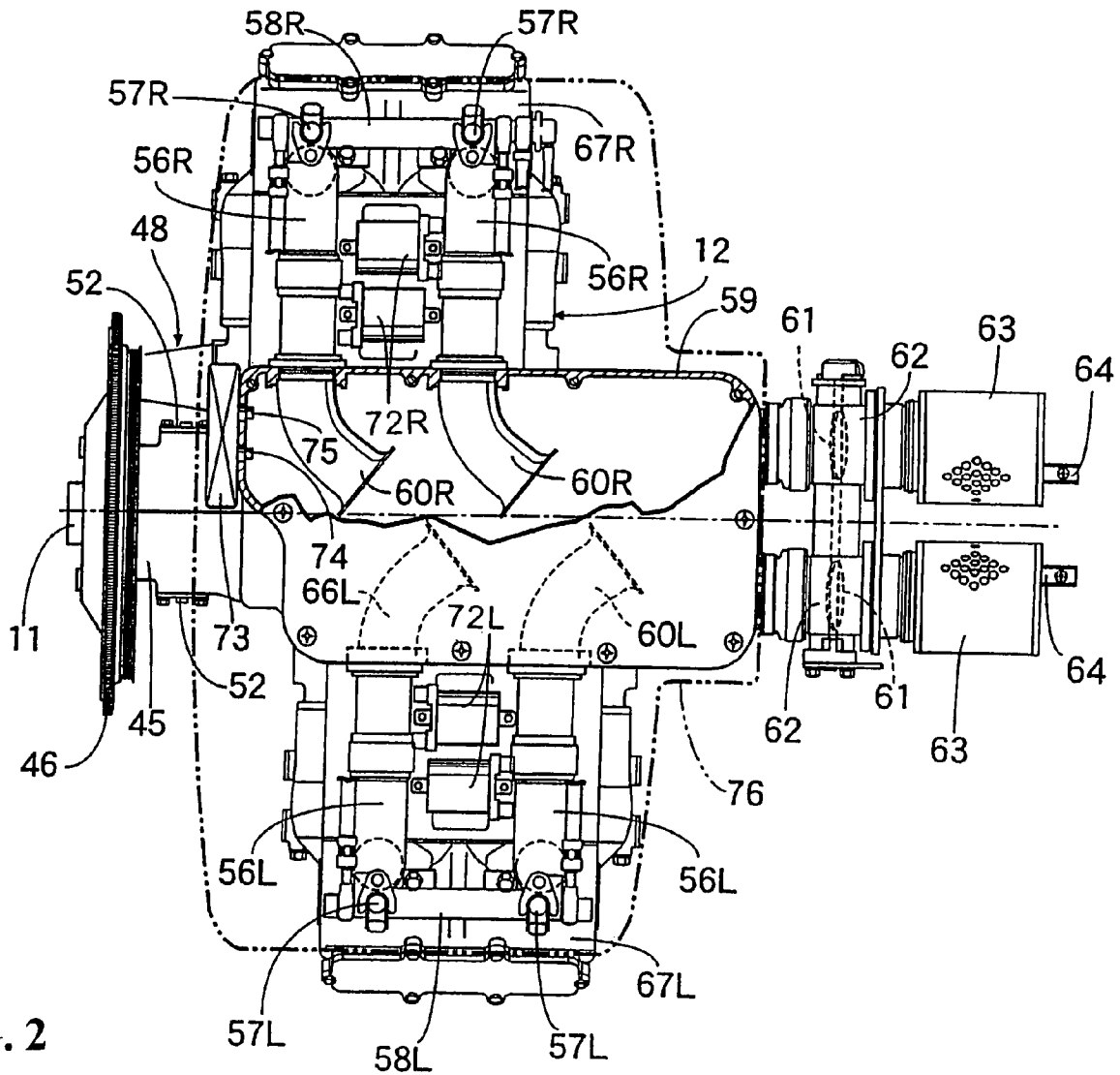
FIG. 2 is a partially cutaway, top plan view of the engine.
Figure 3:
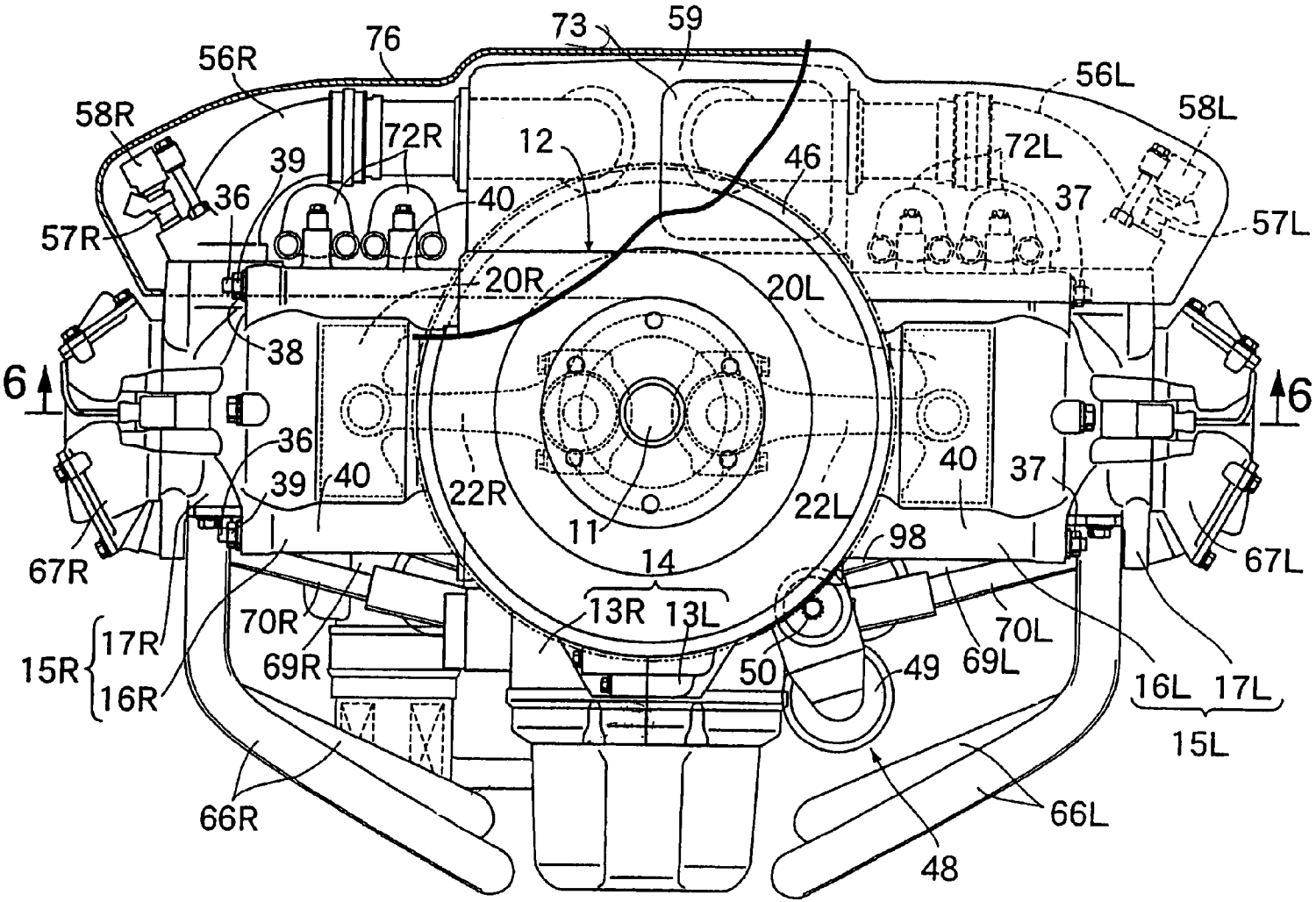
FIG. 3 is an enlarged front view taken in the direction of arrow 3 in FIG. 1.

Referring first to FIGS. 1 to 3, the four-cycle, horizontally opposed, four-cylinder engine is adapted to be mounted on an aircraft in such a manner that the engine is accommodated in a front cowl of the body of the aircraft and the axis of a crankshaft 11 extends in the longitudinal direction of the body of the aircraft. A spinner having a plurality of propeller blades is coaxially connected to the crankshaft 11.

Figure 4:
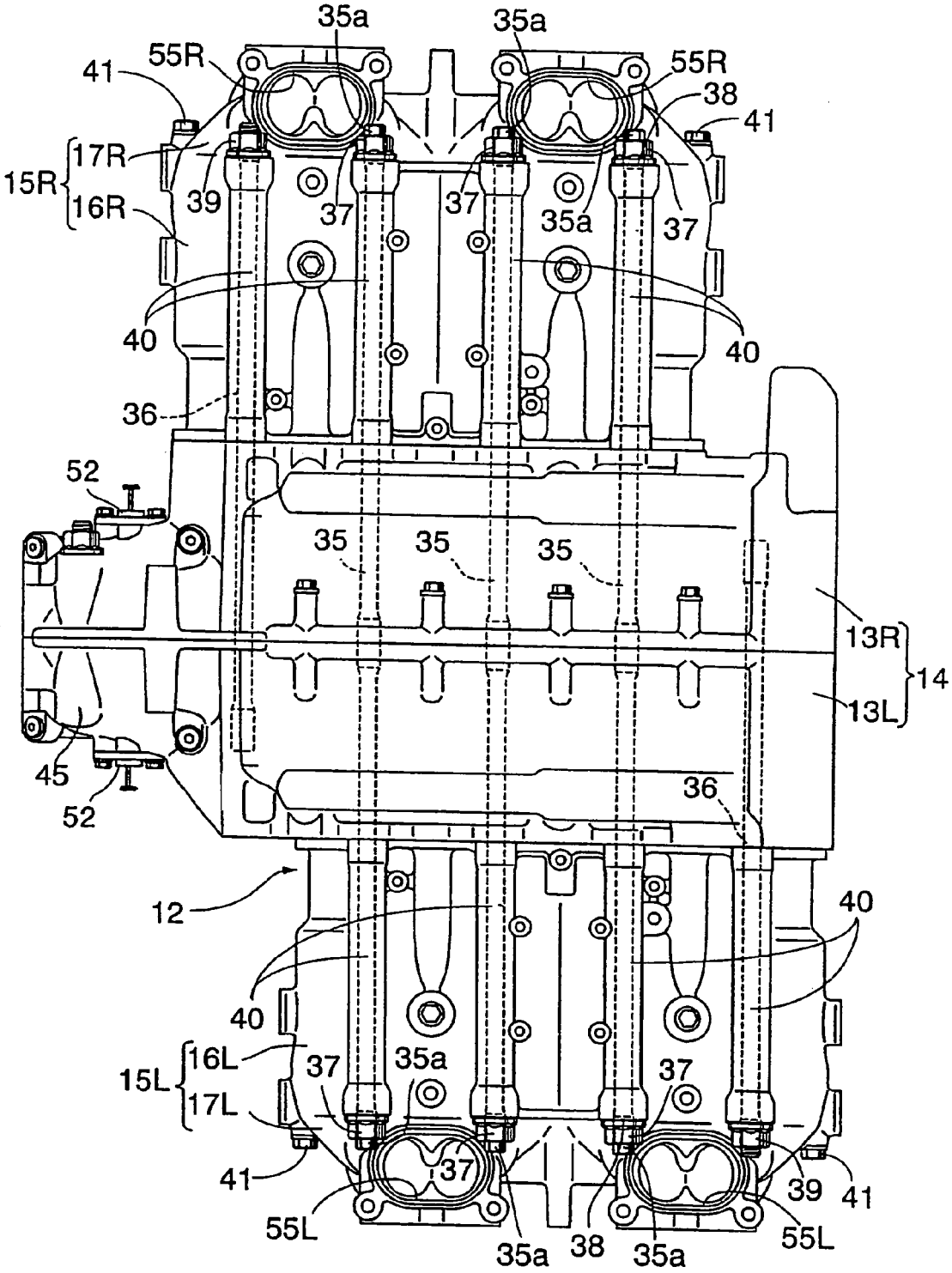
FIG. 4 is a top plan view of an engine body.

Referring also to FIG. 4, the engine has an engine body 12. The engine body 12 is composed of a crankcase 14, a left cylinder block 15L arranged on the left side of the crankcase 14, and a right cylinder block 15R arranged on the right side of the crankcase 14. The crankcase 14 is composed of a left case half 13L and a right case half 13R connected together. The left case half 13L and the right case half 13R are arranged on the left and right sides, respectively, as viewed from the rear side of the engine.

The left cylinder block 15L is composed of a left cylinder barrel 16L and a left cylinder head 17L integrated with each other. Similarly, the right cylinder block 15R is composed of a right cylinder barrel 16R and a right cylinder head 17R integrated with each other.

Figure 5:
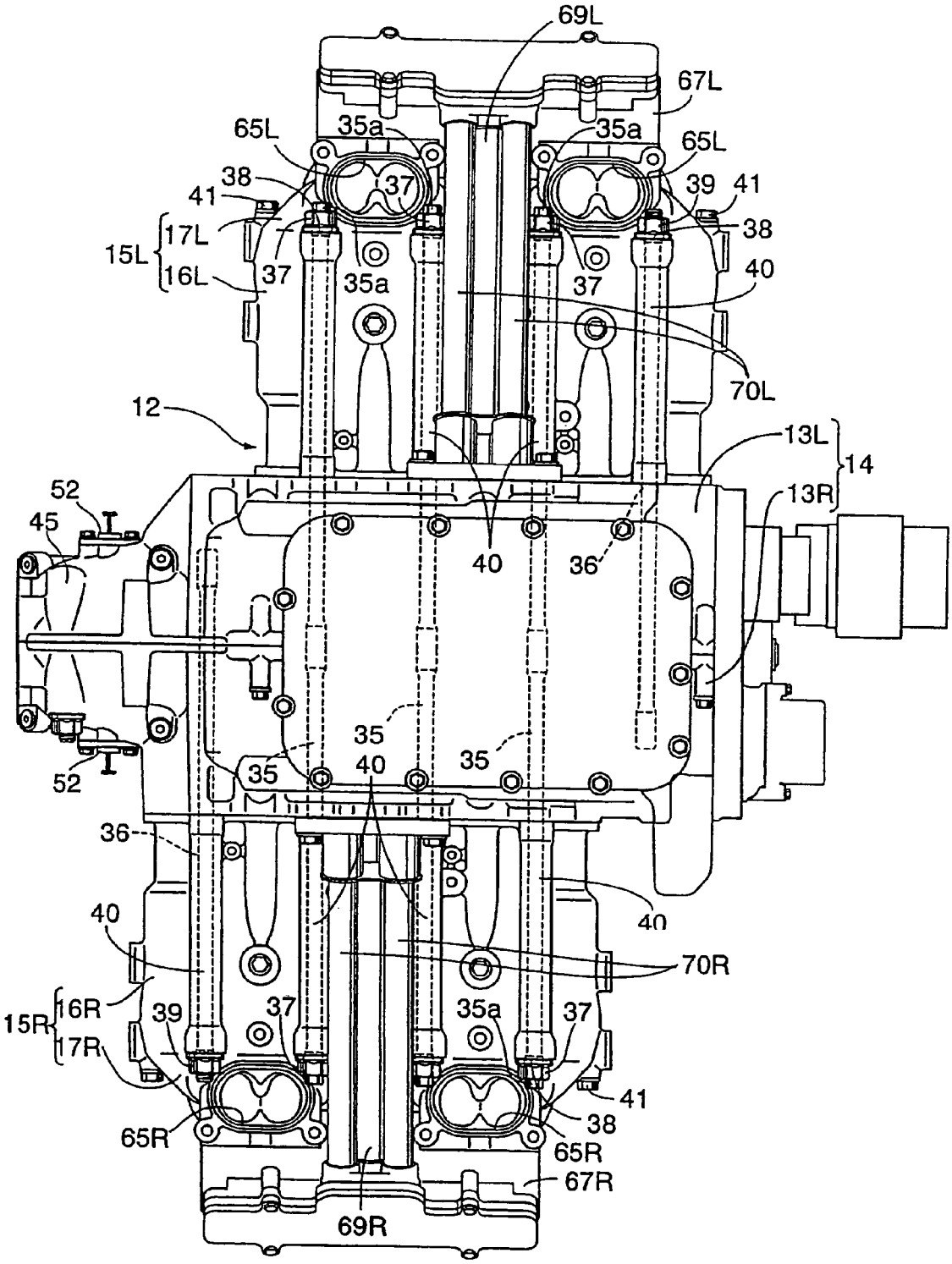
FIG. 5 is a bottom plan view of the engine body.
Figure 6:
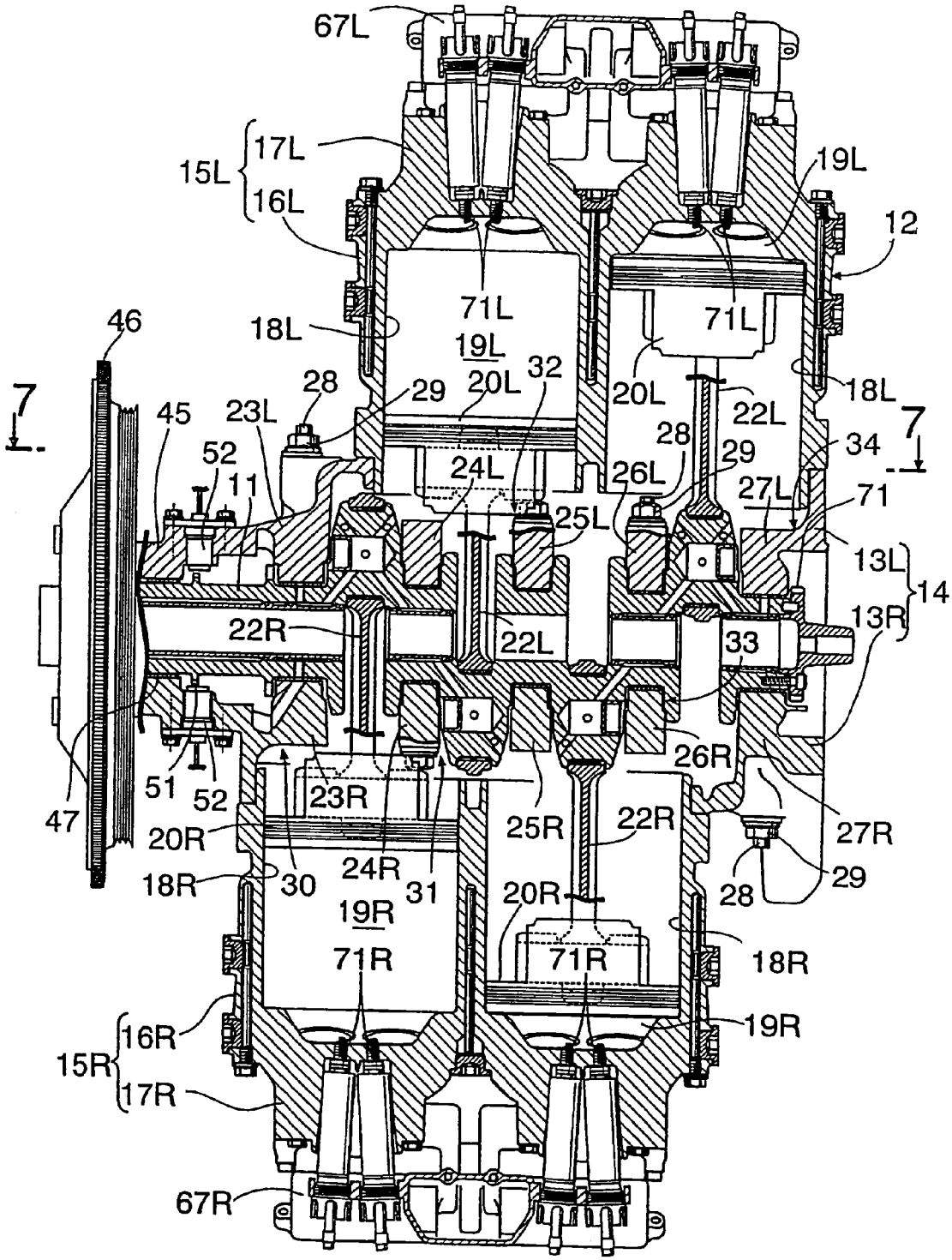
FIG. 6 is a cross section taken along the line 6—6 in FIG. 3.

Referring also to FIGS. 5 and 6, the cylinder barrel 16L of the left cylinder block 15L includes two cylinder bores 18L arranged in the axial direction of the crankshaft 11. Similarly, the cylinder barrel 16R of the right cylinder block 15R includes two cylinder bores 18R arranged in the axial direction of the crankshaft 11. The cylinder bores 18L are opposed to the cylinder bores 18R with the crankshaft 11 interposed therebetween. The cylinder bores 18L are offset from the cylinder bores 18R in the axial direction of the crankshaft 11. A piston 20L is slidably fitted with each cylinder bore 18L, and a combustion chamber 19L is defined between each piston 20L and the cylinder head 17L. Similarly, a piston 20R is slidably fitted with each cylinder bore 18R, and a combustion chamber 19R is defined between each piston 20R and the cylinder head 17R.

The left and right cylinder blocks 15L and 15R are opposed to each other in such a manner that the axes of all the cylinder bores 18L and 18R extend substantially horizontally. The crankshaft 11 is connected through connecting rods 22L and 22R to the pistons 20L and 20R, and is rotatably supported to the crankcase 14.

The left case half 13L of the crankcase 14 is formed with a front journal support wall 23L, first intermediate journal support wall 24L, second intermediate journal support wall 25L, third intermediate journal support wall 26L, and rear journal support wall 27L for supporting a left half portion of the crankshaft 11 on the front and rear sides of the connecting rods 22L. These journal support walls 23L to 27L are spaced from each other in the axial direction of the crankshaft 11. Similarly, the right case half 13R of the crankcase 14 is formed with a front journal support wall 23R, first intermediate journal support wall 24R, second intermediate journal support wall 25R, third intermediate journal support wall 26R, and rear journal support wall 27R for supporting a right half portion of the crankshaft 11 on the front and rear sides of the connecting rods 22R. The journal support walls 23R to 27R are spaced from each other in the axial direction of the crankshaft 11.

Figure 7:
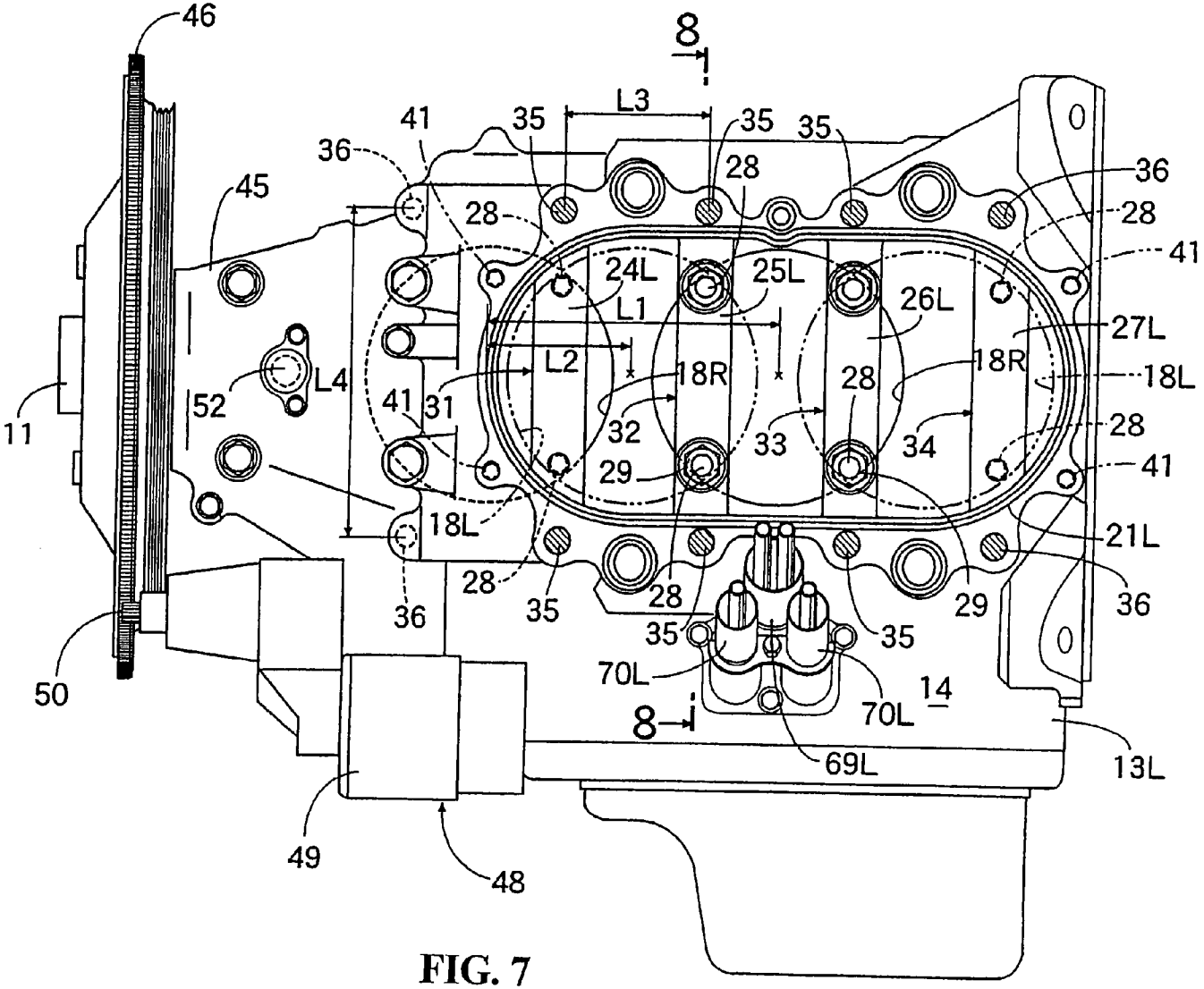
FIG. 7 is a cross section taken along the line 7—7 in FIG. 6.
Figure 8:
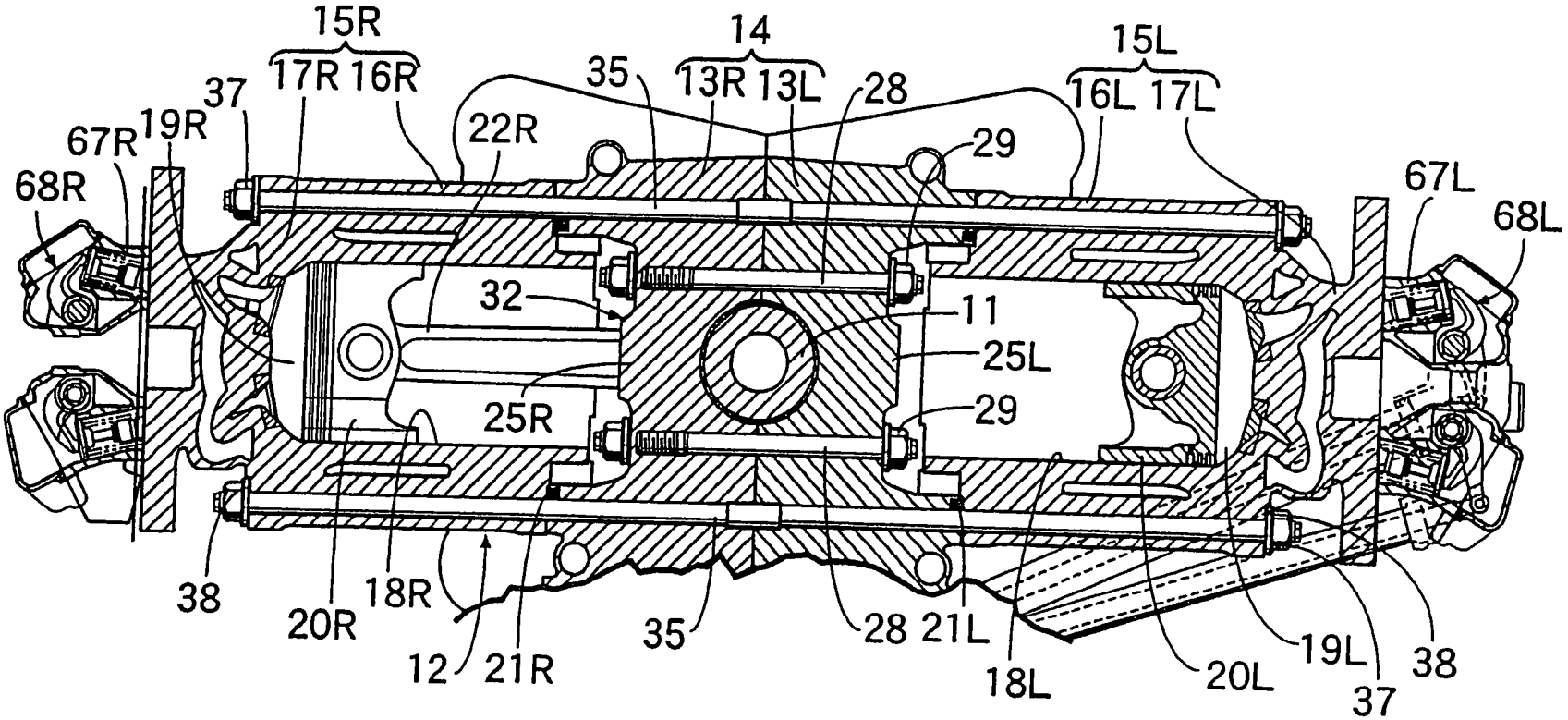
FIG. 8 is a cross section taken along the line 8—8 in FIG. 7.

Referring also to FIGS. 7 and 8, the journal support walls 23L to 27L of the left case half 13L are fastened to the journal support walls 23R to 27R of the right case half 13R, respectively, by a plurality of upper and lower pairs of stud bolts 28 and nuts 29 arranged so that the crankshaft 11 is interposed between each pair of stud bolts 28 and nuts 29, thereby configuring a front bearing portion 30, first intermediate bearing portion 31, second intermediate bearing portion 32, third intermediate bearing portion 33, and rear bearing portion 34. Each of the bearing portions 30 to 34 is dividable along a divisional plane perpendicular to the axes of the cylinder bores 18L and 18R of the left and right cylinder blocks 15L and 15R and arranged on the axis of the crankshaft 11.

The stud bolts 28 for fastening the front journal support walls 23L and 23R and the rear journal support walls 27L and 27R are longer than the stud bolts 28 for fastening the first intermediate journal support walls 24L and 24R, the second intermediate journal support walls 25L and 25R, and the third intermediate journal support walls 26L and 26R.

The stud bolts 28 for fastening the front journal support walls 23L and 23R are implanted into the front journal support wall 23R of the right case half 13R and inserted through the front journal support wall 23L of the left case half 13L. The nuts 29 are threadedly engaged with the stud bolts 28 so as to abut against the outer surface of the left case half 13L. Similarly, the stud bolts 28 for fastening the rear journal support walls 27L and 27R are implanted into the rear journal support wall 27L of the left case half 13L and inserted through the rear journal support wall 27R of the right case half 13R. The nuts 29 are threadedly engaged with the stud bolts 28 so as to abut against the outer surface of the right case half 13R.

The stud bolts 28 for fastening the second intermediate journal support walls 25L and 25R and the third intermediate journal support walls 26L and 26R are implanted into the second and third intermediate journal support walls 25R and 26R of the right case half 13R and inserted through the second and third intermediate journal support walls 25L and 26L of the left case half 13L. The nuts 29 are threadedly engaged with the stud bolts 28 so as to abut against the outer surfaces of the journal support walls 25L and 26L. Similarly, the stud bolts 28 for fastening the first intermediate journal support walls 24L and 24R are implanted into the first intermediate journal support wall 24L of the left case half 13L and inserted through the first intermediate journal support wall 24R of the right case half 13R. The nuts 29 are threadedly engaged with the stud bolts 28 so as to abut against the outer surface of the journal support wall 24R.

The crankcase 14 and the left and right cylinder blocks 15L and 15R are connected together by a plurality of fastening bolts 35 and 36 having axes parallel to the axes of the cylinder bores 18L and 18R and extending through at least the cylinder blocks 15L and 15R, with a compressive structure in the axial direction of the fastening bolts 35 and 36. Further, an oil ring 21L is interposed between the crankcase 14 and the left cylinder block 15L. In addition, an oil ring 21R is interposed between the crankcase 14 and the right cylinder block 15R. These oil rings 21L and 21R are engaged with the crankcase 14.

The fastening bolts 35 are three pairs of upper and lower through bolts located at positions corresponding to the first intermediate journal support walls 24L and 24R, the second intermediate journal support walls 25L and 25R, and the third intermediate journal support walls 26L and 26R. The fastening bolts 35 extend through the crankcase 14 and the left and right cylinder blocks 15L and 15R in such a manner that the stud bolts 28 for fastening the first intermediate journal support walls 24L and 24R, the second intermediate journal support walls 25L and 25R, and the third intermediate journal support walls 26L and 26R are interposed between the fastening bolts 35 and the crankshaft 11.

Nuts 37 are threadedly engaged with the opposite end portions of the fastening bolts 35 projecting from the cylinder heads 17L and 17R of the left and right cylinder blocks 15L and 15R. Further, the opposite ends of each fastening bolt 35 are provided with hexagonal tool engaging portions 35*a* for engaging a tool (not shown), so as to prevent rotation of each fastening bolt 35 in tightening the corresponding nut 37. Each tool engaging portion is provided coaxially with each fastening bolt 35.

The other fastening bolts 36 are two pairs of upper and lower stud bolts. One of the two pairs of fastening bolts 36 are implanted into the front journal support wall 23L of the left case half 13L and inserted through the right cylinder block 15R, and nuts 39 are threadedly engaged with the fastening bolts 36 projecting from the cylinder head 17R of the right cylinder block 15R. Similarly, the other pair of fastening bolts 36 are implanted into the rear journal support wall 27R of the right case half 13R and inserted through the left cylinder block 15L. The nuts 39 are threadedly engaged with the fastening bolts 36 projecting from the cylinder head 17L of the left cylinder block 15L.

The two pairs of fastening bolts 36 are located in such a manner that the stud bolts 28 for fastening the front journal support walls 23L and 23R of the left and right case halves 13L and 13R and the rear journal support walls 27L and 27R of the left and right case halves 13L and 13R are interposed between the fastening bolts 36 and the crankshaft 11.

As shown in FIG. 7, the fastening bolts 35 and 36 are arranged at equal intervals on each of the upper and lower sides of the cylinder bores 18L and 18R in a direction parallel to the axis of the crankshaft 11 in such a manner that four of the fastening bolts 35 and 36 surround each of the cylinder bores 18L and 18R. The upper and lower sides of the cylinder blocks 15L and 15R are integrally formed with a plurality of mounting bosses 40 extending from mount surfaces of the cylinder barrels 16L and 16R to the crankcase 14 to the cylinder heads 17L and 17R. The fastening bolts 35 and 36 are inserted through the mounting bosses 40.

The outer end of each mounting boss 40 is formed as a flat bearing surface 38 against which each of the nuts 37 and 39 abuts. These bearing surfaces 38 are located outside of the combustion chambers 19L and 19R.

The pitch between the two cylinder bores 18L formed in the left cylinder block 15L is equal to the pitch L1 between the two cylinder bores 18R formed in the right cylinder block 15R. The cylinder bores 18L in the left cylinder block 15L are offset rearwardly from the cylinder bores 18R in the right cylinder block 15R in the axial direction of the crankshaft 11 by a given amount L2 equal to ½ of the pitch L1.

The pitch L3 of the fastening bolts 35 and 36 in the axial direction of the crankshaft 11 is smaller than the pitch L4 of the fastening bolts 35 and 36 in a vertical direction perpendicular to the axial direction of the crankshaft 11. That is, L3<L4.

The left and right cylinder blocks 15L and 15R can be preliminarily fastened to the crankcase 14 by a plurality of temporary bolts 41 parallel to the fastening bolts 35 and 36. That is, after fastening the left and right case halves 13L and 13R by using the stud bolts 28 and the nuts 29 to assemble the crankcase 14, the left and right cylinder blocks 15L and 15R are temporarily assembled to the crankcase 14 by using the temporary bolts 41. In this condition, the fastening bolts 35 and 36 are inserted through the cylinder blocks 15L and 15R and the crankcase 14. Accordingly, disengagement, from the crankcase 14, of the oil ring 21L (interposed between the crankcase 14 and the left cylinder block 15L) and the oil ring 21R (interposed between the crankcase 14 and the right cylinder block 15R) can be prevented. Meanwhile, the insertion of the fastening bolts 35 and 36 can be easily performed, thereby contributing to an improvement in mountability and maintainability.

A support cylinder 45 is formed at the front end of the crankcase 14 so as to project forwardwardly. The support cylinder 45 is configured by the left and right case halves 13L and 13R in cooperation. The front end of the crankshaft 11 extends coaxially through the support cylinder 45 and projects from the front end of the support cylinder 45. A ring gear 46 is fixed to the front end of the crankshaft 11 projecting from the front end of the support cylinder 45 with a spinner (not shown) that is coaxially mounted on the ring gear 46. A sliding bearing 47 is interposed between the support cylinder 45 and the crankshaft 11 at their front portions. Further, an annular sealing member (not shown) is interposed between the support cylinder 45 and the crankshaft 11 at a position on the front side of the sliding bearing 47.

A starting device 48 is provided to give a rotational drive force to the crankshaft 11 at the start of the engine. The starting device 48 has a known structure that includes a starter motor 49 supported on a lower portion of the left case half 13L of the crankcase 14 and a pinion 50 adapted to project into mesh with the ring gear 46 when the rotational speed of the starter motor 49 becomes greater than or equal to a predetermined value. After starting the engine, the pinion 50 is separated from the ring gear 46 and returned to an original position.

A plurality of projections 51 are formed on the crankshaft 11 in the support cylinder 45 so as to be equally spaced in the circumferential direction of the crankshaft 11. A pair of crank angle sensors 52 for detecting a crank angle by using the projections 51 are mounted in the support cylinder 45 so as to provide a 180° phase difference.

The left cylinder head 17L is formed at its upper portion with two intake ports 55L, respectively, corresponding to the two combustion chambers 19L. Similarly, the right cylinder head 17R is formed at its upper portion with two intake ports 55R, respectively, corresponding to the two combustion chambers 19R. Each intake port 55L is bifurcated to communicate with the corresponding combustion chamber 19L, and each intake port 55R is also bifurcated to communicate with the corresponding combustion chamber 19R.

Arcuately curved intake pipes 56L and 56R are connected to the intake ports 55L and 55R, respectively. Electromagnetic fuel injection valves 57L and 57R for injecting fuel toward the intake ports 55L and 55R are mounted at intermediate portions of the intake pipes 56L and 56R, respectively. The fuel injection valves 57L on the left cylinder block 15L side are connected to a common fuel rail 58L. The fuel injection valves 57R on the right cylinder block 15R side are connected to a common fuel rail 58R.

An intake chamber 59 is located above the crankcase 14 of the engine body 12 so as to be supported to the engine body 12. The upstream ends of the intake pipes 56L and 56R are connected to the downstream ends of connection pipes 60L and 60R, respectively. The upstream end portions of the connection pipes 60L and 60R are inserted in the intake chamber 59 from the opposite sides thereof, and are curved to be divergent and open to the rear side.

A pair of right and left throttle bodies 62 each including a throttle valve 61 rotatably supported to a lateral shaft are connected at their downstream ends to the rear end of the intake chamber 59. Air cleaners 63 are connected to the upstream ends of the throttle bodies 62, respectively. The air cleaners 63 are supported by support stays 64 mounted to the intake chamber 59 and extending rearward.

The left cylinder head 17L is formed at its lower portion with two exhaust ports 65L, respectively, corresponding to the two combustion chambers 19L. Similarly, the right cylinder bead 17R is formed at its lower portion with two exhaust ports 65R, respectively, corresponding to the two combustion chambers 19R. Each exhaust port 65L is bifurcated, and each exhaust port 65R is also bifurcated. Exhaust pipes 66L and 66R are connected to the exhaust ports 65L and 65R, respectively. The exhaust pipes 66L and 66R extend downwardly to the lower side of the engine body 12 and further extend rearwardly.

Substantially H-shaped head covers 67L and 67R are connected to the left and right cylinder heads 17L and 17R, respectively. A valve train 68L for driving intake valves and exhaust valves related to the combustion chambers 19L is provided between the bead cover 67L and the cylinder head 17L. Similarly, a valve train 68R for driving intake valves and exhaust valves related to the combustion chambers 19R is provided between the head cover 67R and the cylinder head 17R. The intake valves and the exhaust valves related to the combustion chambers 19L control the intake of air or air/fuel mixture into the combustion chambers 19L and the exhaust of burned gases from the combustion chambers 19L, respectively. The same as described above also applies to the intake valves and the exhaust valves of the combustion chambers 19R.

A valve opening force for the intake valves to be driven by the valve train 68L is obtained by a push rod adapted to be pushed up in an intake stroke by the power transmitted from the crankshaft 11. The push rod is provided per cylinder, i.e., for each combustion chamber 19L and is axially movably inserted in a push rod guide pipe 69L located below the left cylinder block 15L. The push rod guide pipe 69L extends between a longitudinally central position of a lower portion of the left case half 13L and the head cover 67L. The same as described above also applies to the valve train 68R side.

A valve opening force for the exhaust valves to be driven by the valve train 68L is obtained by a pull rod adapted to be pulled down in an exhaust stroke by the power transmitted from the crankshaft 11. The pull rod is provided per cylinder, i.e., for each combustion chamber 19L and is axially movably inserted in a pull rod guide pipe 70L located below the push rod guide pipe 69L. The pull rod guide pipe 70L also extends between the longitudinally central position of the lower portion of the left case half 13L and the head cover 67L. The same as described above also applies to the valve train 68R side.

A pair of spark plugs 71L are mounted for each combustion chamber 19L in the left cylinder head 17L. A pair of spark plugs 71R are mounted for each combustion chamber 19R in the right cylinder head 17R. A pair of ignition coils 72L are mounted on the upper surface of the left cylinder head 17L at a position between the intake pipes 56L. In addition, a pair of ignition coils 72R are mounted on the upper surface of the right cylinder head 17R at a position between the intake pipes 56R. These pairs of ignition coils 72L and 72R are located on the opposite sides of the intake chamber 59.

An electronic control unit 73 for controlling the operation of the engine is mounted on the outer surface of the front wall of the intake chamber 59. An intake air pressure sensor 74 for detecting the intake air pressure in the intake chamber 59 and an intake air temperature sensor 75 for detecting the intake air temperature in the intake chamber 59 project from the electronic control unit 73 through the front wall of the intake chamber 59 into the intake chamber 59.

The electromagnetic fuel injection valves 57L and 57R, the ignition coils 72L and 72R, and the electronic control unit 73 are arranged around the intake chamber 59 and are covered with a shield cover 76 mounted on the engine body 12 so as to cover at least a part of the intake chamber 59.

The operation of the first preferred embodiment mentioned above will now be described. The cylinder barrel 16L and the cylinder head 17L are integrated with each other to form the cylinder block 15L. Similarly, the cylinder barrel 16R and the cylinder head 17R are integrated with each other to form the cylinder block 15R. The cylinder blocks 15L and 15R and the crankcase 14 are fastened together by the plural fastening bolts 35 and 36 having axes parallel to the axes of the cylinder bores 18L and 18R, respectively, formed in the cylinder blocks 15L and 15R and extending through at least the cylinder blocks 15L and 15R, with a compressive structure in the axial direction of these fastening bolts 35 and 36.

Accordingly, the bolts 35 and 36 for fastening the crankcase 14, the cylinder barrels 16L and 16R, and the cylinder heads 17L and 17R can be reduced in number to thereby improve the mountability and maintainability. Further, any gaskets for high temperature and high pressure that are conventionally required between the cylinder barrel 16L and the cylinder head 17L and between the cylinder barrel 16R and the cylinder head 17R can be eliminated, so that axial tensions of the fastening bolts 35 and 36 can be controlled. Further, it is sufficient for the fastening bolts 35 and 36 to have a strength withstanding a tensile stress due to the combustion in the combustion chambers 19L and 19R. Accordingly, the fastening bolts 35 and 36 can be relatively reduced in number, and the diameter of each of the fastening bolts 35 and 36 can be set to a relatively small value. Further, any fastening portions conventionally required between the cylinder barrel 16L and the cylinder head 17L and between the cylinder barrel 16R and the cylinder head 17R can be eliminated, thereby obtaining an advantage in size and a reduction in the weight of the engine.

The engine is of a horizontally opposed type including the pair of left and right cylinder blocks 15L and 15R and the pair of left and right case halves 13L and 13R constituting the crankcase 14 located between the cylinder blocks 15L and 15R. The left cylinder block 15L includes the cylinder bores 18L, and the right cylinder block 15R includes the cylinder bores 18R offset from the cylinder bores 18L in the axial direction of the crankshaft 11. The left case half 13L includes the plural journal support walls 23L to 27L, and the right case half 13R includes the plural journal support walls 23R to 27R cooperating with the plural journal support walls 23L to 27L to form the bearing portions 30 to 34 for rotatably supporting the crankshaft 11. The fastening bolts 35 and 36 are located at positions corresponding to the journal support walls 23L to 27L and 23R to 27R, so that the size enlargement of the engine due to the location of the fastening bolts 35 and 36 can be avoided. Meanwhile, the journal support walls 23L to 27L and 23R to 27R of the left and right case halves 13L and 13R can be firmly coupled together to support the crankshaft 11.

Further, the plural cylinder bores 18L formed in the left cylinder block 15L are offset rearward from the plural cylinder bores 18R formed in the right cylinder block 15R in the axial direction of the crankshaft 11 by a given amount equal to ½ of the pitch L1 of the cylinder bores 18L (or the cylinder bores 18R). With this arrangement, the coordinates of the fastening bolts 35 and 36 in the left cylinder block 15L can be set equal to those of the fastening bolts 35 and 36 in the right cylinder block 15R, and the cylinder blocks 15L and 15R having the same shape can be located on the left and right sides of the crankcase 14.

Further, the plural pairs of upper and lower fastening bolts 35 and upper and lower fastening bolts 36 are located so as to respectively correspond to the journal support walls 23L to 27L and 23R to 27R. Accordingly, the fastening forces between the journal support walls 23L to 27L and 23R to 27R by the fastening bolts 35 and 36 can be made uniform, and the crankshaft 11 can be reduced in weight.

To increase the roundness of the cylinder bores 18L and 18R after assembling the engine body 12 by using the fastening bolts 35 and 36, it is preferable to apply the same load as the fastening load by the fastening bolts 35 and 36 to each bearing surface 38 in polishing the inner surfaces of the cylinder bores 18L and 18R, such as by honing. In this case, when the load applied to each bearing surface 38 is removed after polishing the inner surfaces of the cylinder bores 18L and 18R, the cylinder bores 18L and 18R are minutely deformed so as to increase their inner diameters. On the other hand, the pistons 20L and 20R have skirt portions arranged in a direction perpendicular to the axial direction of the crankshaft 11 and slidably fitted with the cylinder bores 18L and 18R. Each skirt portion is machined so as to have an outer shape along an elliptical shape having a major axis extending in a direction perpendicular to the axial direction of the crankshaft 11. If the cross-sectional shape of each of the cylinder bores 18L and 18R does not correspond to the outer shape of each skirt portion, it is difficult to fit the pistons 20L and 20R into the cylinder bores 18L and 18R.

Figure 9:
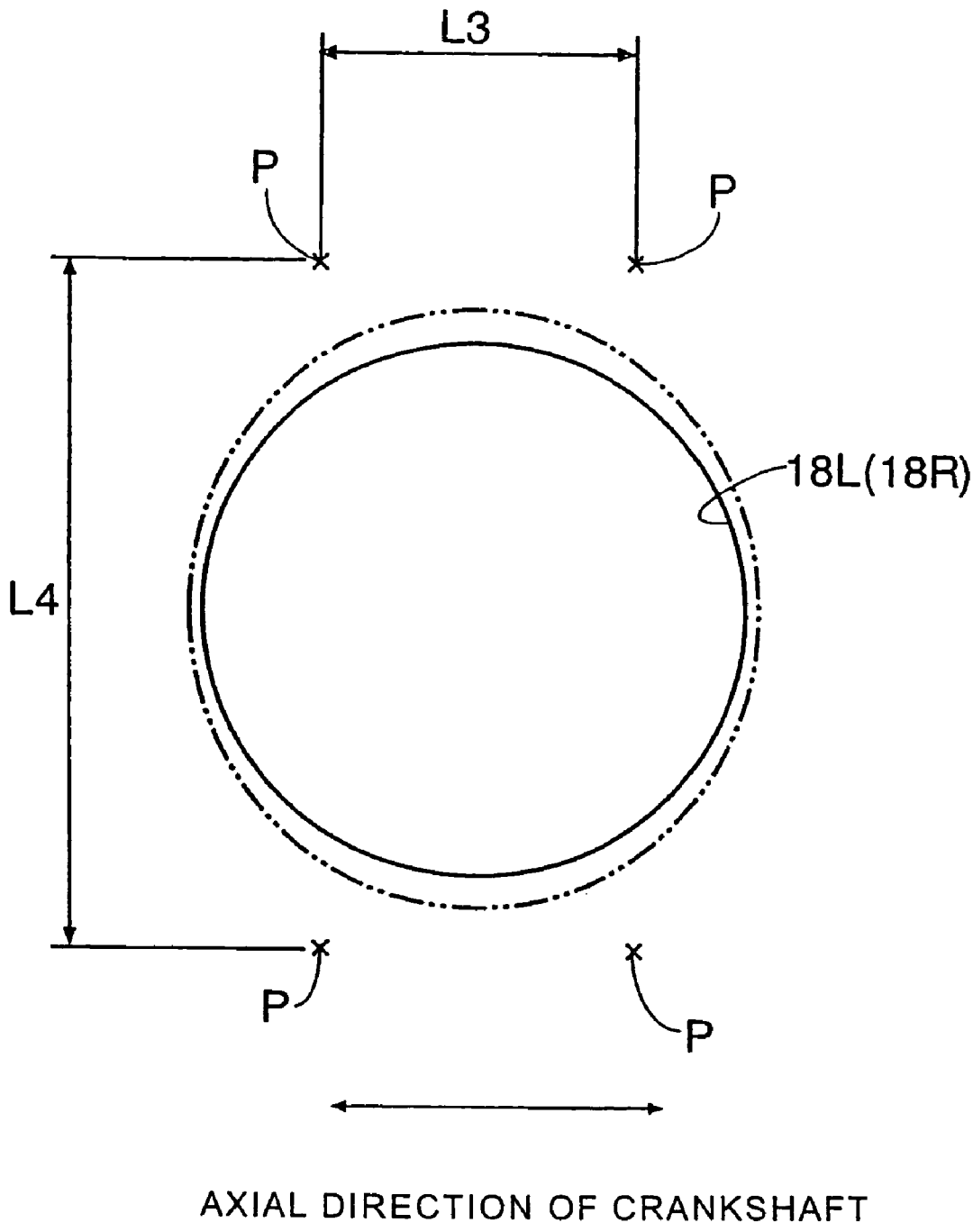
FIG. 9 is a view for illustrating the deformation of a cylinder bore.

As mentioned above, the fastening bolts 35 and 36 are arranged at equal intervals on each of the upper and lower sides of the cylinder bores 18L and 18R in a direction parallel to the axis of the crankshaft 11 in such a manner that four of the fastening bolts 35 and 36 surround each of the cylinder bores 18L and 18R. On the other hand, as shown in FIG. 9, four compressive load application points P around each of the cylinder bores 18L and 18R in working the inner surfaces of the cylinder bores 18L and 18R are present at the same positions as those of the fastening bolts 35 and 36. Furthermore, the pitch L3 of the fastening bolts 35 and 36 in the axial direction of the crankshaft 11 is set smaller than the pitch L4 of the fastening bolts 35 and 36 in a vertical direction perpendicular to the axial direction of the crankshaft 11. Therefore, the pitch L3 of the compressive load application points P in the axial direction of the crankshaft 11 is smaller than the pitch L4 of the compressive load application points P in the vertical direction perpendicular to the axial direction of the crankshaft 11.

Accordingly, in working the inner surfaces of the cylinder bores 18L and 18R in the condition where loads are applied to the points P, a stress acting to reduce the inner diameter of each of the cylinder bores 18L and 18R in the vertical direction perpendicular to the axial direction of the crankshaft 11 becomes larger than that acting to reduce the inner diameter of each of the cylinder bores 18L and 18R in the axial direction of the crankshaft 11. When the load applied to each bearing surface 38 is removed after working the inner surfaces of the cylinder bores 18L and 18R as shown by a solid line in FIG. 9, the cylinder bores 18L and 18R are minutely deformed so that their inner diameters are increased so as to form an elliptical shape having a major axis extending in the vertical direction perpendicular to the axial direction of the crankshaft 11 as shown by a phantom line in FIG. 9. Thus, such an elliptical cross-sectional shape of each of the cylinder bores 18L and 18R corresponds to the outer shape of the skirt portion of each of the pistons 20L and 20R, so that the pistons 20L and 20R can be easily fitted into the cylinder bores 18L and 18R.

In FIG. 9, the cross-sectional shape of the cylinder bores 18L and 18R that are deformed as shown by the phantom line is exaggerated for purposes of illustration.

Figure 10:
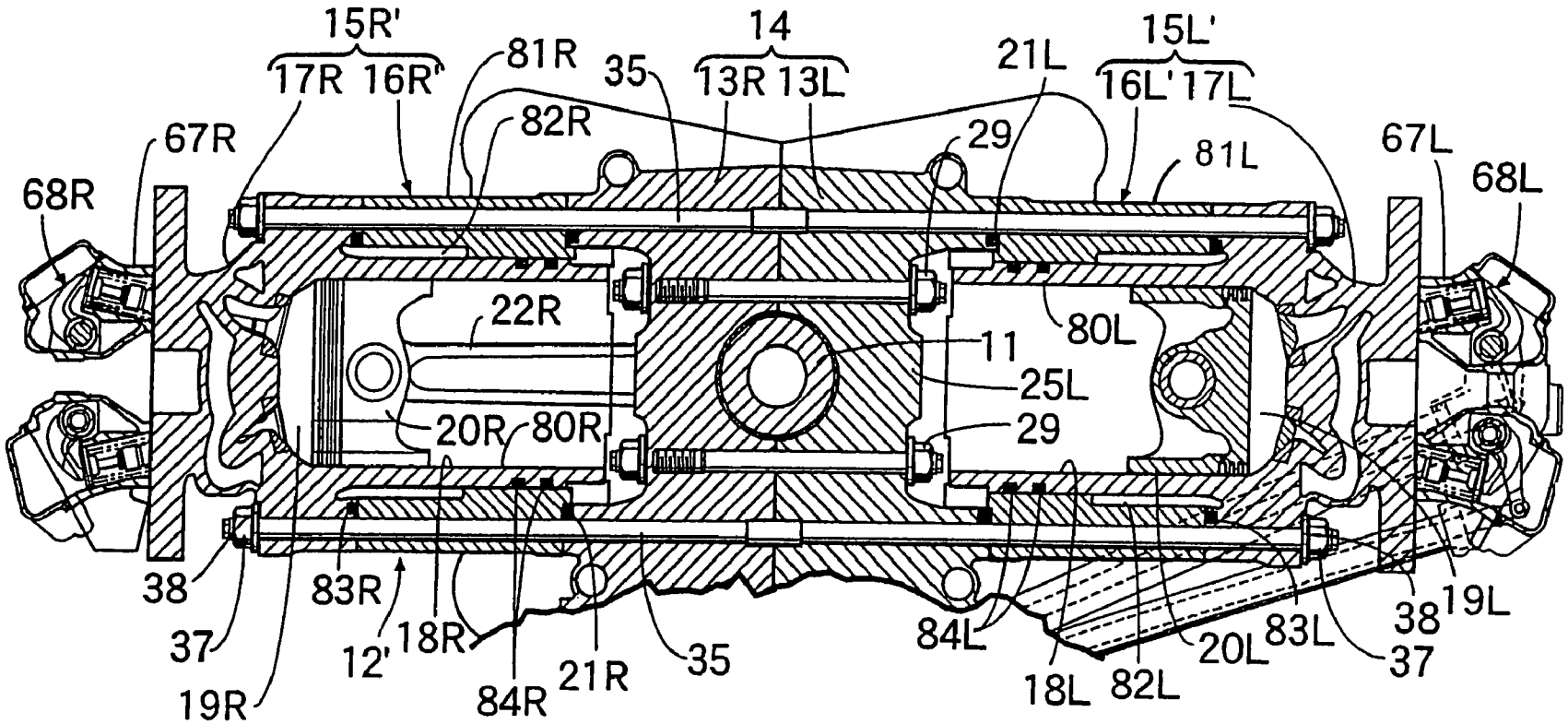
FIG. 10 is a sectional view similar to FIG. 8, showing a second preferred embodiment of the present invention.

FIG. 10 shows a second preferred embodiment of the present invention, in which the same parts as those in the first preferred embodiment are denoted by the same reference characters.

The engine according to the second preferred embodiment has an engine body 12'. The engine body 12' is composed of a crankcase 14 and left and right cylinder blocks 15L' and 15R', respectively, arranged on the left and right sides of the crankcase 14.

The left cylinder block 15L' is composed of a left cylinder barrel 16L' and a left cylinder head 17L. Similarly, the right cylinder block 15R' is composed of a right cylinder barrel 16R' and a right cylinder head 17R.

The left cylinder barrel 16L' is composed of a cylinder forming member 80L forming cylinder bores 18L and an outer shell 81L surrounding the cylinder forming member 80L so as to define a cooling water jacket 82L therebetween. The outer shell 81L is held between the cylinder head 17L and the crankcase 14. Similarly, the right cylinder barrel 16R' is composed of a cylinder forming member 80R forming cylinder bores 18R and an outer shell 81R surrounding the cylinder forming member 80R so as to define a cooling water jacket 82R therebetween. The outer shell 81R is held between the cylinder head 17R and the crankcase 14.

The left cylinder head 17L is integrated with the portion of the cylinder barrel 16L' where the cylinder bores 18L are formed, that is, integrated with the cylinder forming member 80L. Similarly, the right cylinder head 17R is integrated with the portion of the cylinder barrel 16R' where the cylinder bores 18R are formed, that is, integrated with the cylinder forming member 80R.

A seal member 83L and a pair of seal members 84L for sealing the cooling water jacket 82L are interposed between the cylinder forming member 80L and the outer shell 81L. Similarly, a seal member 83R and a pair of seal members 84R for sealing the cooling water jacket 82R are interposed between the cylinder forming member 80R and the outer shell 81R. Further, no gasket is required between the cylinder barrel 16L' and the cylinder head 17L because no leakage from the combustion chambers 19L occurs. Similarly, no gasket is required between the cylinder barrel 16R' and the cylinder head 17R because no leakage from the combustion chambers 19R occurs.

The crankcase 14 and the cylinder blocks 15L' and 15R' are fastened together by a plurality of fastening bolts 35 and 36 (see the first preferred embodiment) having axes parallel to the axes of the cylinder bores 18L and 18R and extending through at least the cylinder blocks 15L' and 15R', with a compressive structure in the axial direction of the fastening bolts 35 and 36. The fastening bolts 35 and 36 extend through the outer shells 81L and 81R of the cylinder barrels 16L' and 16R'.

According to the second preferred embodiment, effects similar to those of the first preferred embodiment can be exhibited. In addition, no compressive loads are applied to the portions of the cylinder barrels 16L' and 16R' for forming the cylinder bores 18L and 18R, that is, to the cylinder forming members 80L and 80R. Accordingly, the distortion of the cylinder bores 18L and 18R due to the application of compressive loads can be prevented. Further, the cylinder forming members 80L and 80R and the outer shells 81L and 81R can be easily formed by casting, and the cooling water jackets 82L and 82R can be easily formed in the cylinder barrels 16L' and 16R'.

Having thus described specific preferred embodiments of the present invention, it should be noted that the present invention is not limited to the above preferred embodiments, but various modifications may be made without departing from the scope of the present invention.

For example, each fastening bolt 36 is a stud bolt having one end implanted in the crankcase 14 in the above preferred embodiments. As a modification, each fastening bolt 36 may be a through bolt having one end projecting from the crankcase 14.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine having a crankshaft, a crankcase having a plurality of bearing portions for rotatably supporting said crankshaft, each of said bearing portions being dividable along a divisional plane arranged on the axis of said crankshaft, cylinder barrels connected to said crankcase, said cylinder barrels having cylinder bores with axes perpendicular to said divisional plane, and cylinder heads connected to said cylinder barrels comprising:

said cylinder heads being integrated with portions of said cylinder barrels forming at least said cylinder bores to form cylinder blocks; and said cylinder blocks and said crankcase being fastened together by a plurality of fastening bolts having axes parallel to the axes of said cylinder bores and extending through at least said cylinder blocks, with a compressive structure in the axial direction of the fastening bolts;

wherein the fastening bolts are arrange in equal intervals on each of upper and lower sides of the cylinder bores in a direction parallel to the axis of the crankshaft in such a manner that four of the fastening bolts surround each of the cylinder bores, wherein a pitch of the fastening bolts in the axial direction of the crankshaft is set smaller than a pitch of the fastening bolts in a vertical direction perpendicular to the axial direction of the crankshaft, and upper and lower sides of the cylinder blocks are integrally formed with a plurality of mounting bosses extending from mounting surfaces of the cylinder barrels to the crankcase to the cylinder heads.

2. The engine according to claim 1, wherein said engine is of a horizontally opposed type including a pair of left and right cylinder blocks and a pair of left and right case halves connected together to constitute said crankcase located between said left and right cylinder blocks;

said left and right cylinder blocks have a plurality of left and right cylinder bores offset from each other in the axial direction of said crankshaft;

said left and right case halves have a plurality of journal support walls cooperating with each other to form said bearing portions; and said fastening bolts are located at positions corresponding to said journal support walls.

3. The engine according to claim 2, wherein said plurality of left cylinder bores formed in said left cylinder block are offset from said plurality of right cylinder bores formed in said right cylinder block in the axial direction of said crankshaft by a given amount equal to ½ of the pitch of said left cylinder bores or said right cylinder bores.

4. The engine according to claim 1, and further including an oil ring interposed between the crankcase and the cylinder blocks with the oil ring being engaged with the crankcase.

5. The engine according to claim 2, and further including stud bolts for fastening the individual journal support walls of the plurality of journal support walls, said stud bolts being interposed between the fastening bolts and the crankshaft.

6. The engine according to claim 1, and further including nuts threadedly engaged with opposite end portions of each of the fastening bolts that project from the cylinder heads.

7. The engine according to claim 1, wherein said fastening bolts are inserted within said mounting bosses.

8. The engine according to claim 7, wherein outer ends of each mounting boss includes a flat bearing surface for positioning a nut for securing the fastening bolts relative to the cylinder blocks and the crankcase.

9. The engine according to claim 1, wherein the cylinder barrels are formed with cylinder forming members for defining a cooling jacket cavity between the cylinder barrels and the cylinder bores.

10. An engine comprising:

a crankcase;

cylinder barrels connected to said crankcase, said cylinder barrels including cylinder bores;

cylinder heads connected to said cylinder barrels;

cylinder blocks formed by said cylinder heads being integrated with portions of said cylinder barrels for forming at least said cylinder bores; and a plurality of fastening bolts having axes parallel to the axes of said cylinder bores and extending through at least said cylinder blocks with a compressive structure in the axial direction of the fastening bolts for fastening together the cylinder blocks and the crankcase, wherein the fastening bolts are arrange in equal intervals on each of upper and lower sides of the cylinder bores in a direction parallel to the axis of the crankshaft in such a maimer that four of the fastening bolts surround each of the cylinder bores, wherein a pitch of the fastening bolts in the axial direction of the crankshaft is set smaller than a pitch of the fastening bolts in a vertical direction perpendicular to the axial direction of the crankshaft, and upper and lower sides of the cylinder blocks are integrally formed with a plurality of mounting bosses extending from mounting surfaces of the cylinder barrels to the crankcase to the cylinder heads.

11. The engine according to claim 10, wherein said engine is of a horizontally opposed type including a pair of left and right cylinder blocks and a pair of left and right case halves connected together to constitute said crankcase located between said left and right cylinder blocks;

said left and right cylinder blocks have a plurality of left and right cylinder bores offset from each other in the axial direction of said crankshaft;

said left and right case halves have a plurality of journal support walls cooperating with each other to form said bearing portions; and said fastening bolts are located at positions corresponding to said journal support walls.

12. The engine according to claim 11, wherein said plurality of left cylinder bores formed in said left cylinder block are offset from said plurality of right cylinder bores formed in said right cylinder block in the axial direction of said crankshaft by a given amount equal to ½ of the pitch of said left cylinder bores or said right cylinder bores.

13. The engine according to claim 11, and further including stud bolts for fastening the individual journal support walls of the plurality of journal support walls, said stud bolts being interposed between the fastening bolts and the crankshaft.

14. The engine according to claim 10, and further including an oil ring interposed between the crankcase and the cylinder blocks with the oil ring being engaged with the crankcase.

15. The engine according to claim 10, and further including nuts threadedly engaged with opposite end portions of each of the fastening bolts that project from the cylinder heads.

16. The engine according to claim 10, wherein said fastening bolts are inserted within said mounting bosses.

17. The engine according to claim 16, wherein outer ends of each mounting boss includes a flat bearing surface for positioning a nut for securing the fastening bolts relative to the cylinder blocks and the crankcase.

18. The engine according to claim 10, wherein the cylinder barrels are formed with cylinder forming members for defining a cooling jacket cavity between the cylinder barrels and the cylinder bores.

* * * * *